United States Patent [19]

Sorrells

[11] 4,419,849

[45] * Dec. 13, 1983

[54] LENS PROCESSING METHOD AND APPARATUS

[75] Inventor: Frank D. Sorrells, Knoxville, Tenn.

[73] Assignee: Cole National Corporation, Cleveland, Ohio

[ * ] Notice: The portion of the term of this patent subsequent to May 19, 1998 has been disclaimed.

[21] Appl. No.: 233,323

[22] Filed: Feb. 11, 1981

[51] Int. Cl.[3] ..... B24B 1/00

[52] U.S. Cl. ..... 51/284 R

[58] Field of Search ..... 51/284 R, 284 E, 216 LP, 51/217 L

[56] References Cited

U.S. PATENT DOCUMENTS

| | | | |
|---|---|---|---|
| 3,431,688 | 3/1969 | Rudd et al. | 51/284 R |
| 3,913,274 | 10/1975 | Raiford et al. | 51/284 |
| 4,149,344 | 4/1979 | Keane | 51/284 R |
| 4,267,672 | 5/1981 | Sorrells | 51/216 LP |

*Primary Examiner*—Harold D. Whitehead

*Attorney, Agent, or Firm*—Fay & Sharpe

[57] ABSTRACT

A chucking method and apparatus for processing a lens blank in a manner requiring only a single mounting of the blank to an associated lens block. The lens block is mounted to the convex lens blank surface by a hot melt type of adhesive so as to extend outwardly thereof substantially coaxial with the lens blank frame center axis. The lens blank and lens block are releasably mounted in a chuck assembly associated with lens surface generating apparatus such that a desired optical center axis in the lens blank and the tailstock of the generating apparatus are coaxial. The chuck includes means for selectively rotating and/or canting the lens blank relative to the tailstock to accommodate desired axis and prism settings as prescribed for the finished lens. Following generation of the desired optical characteristics in the lens blank, additional operations are performed thereon for producing a finished optical lens while the lens block remains affixed thereto. After these additional operations are completed, the lens block is removed from mounted association with the finished optical lens.

5 Claims, 11 Drawing Figures

FIG. 1
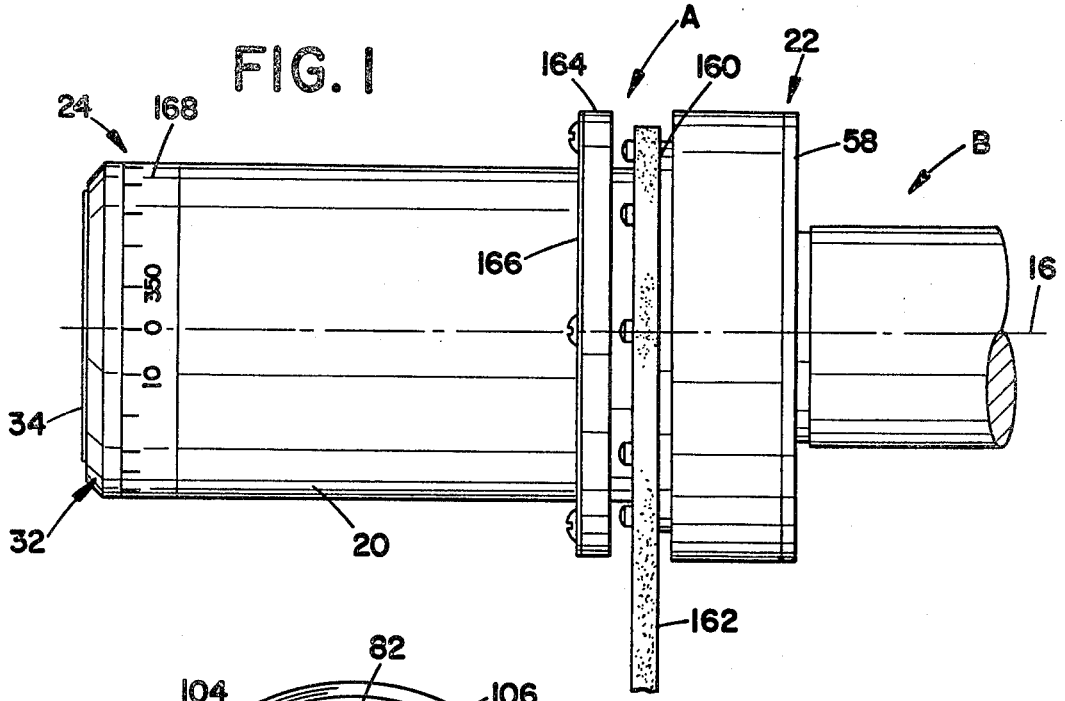
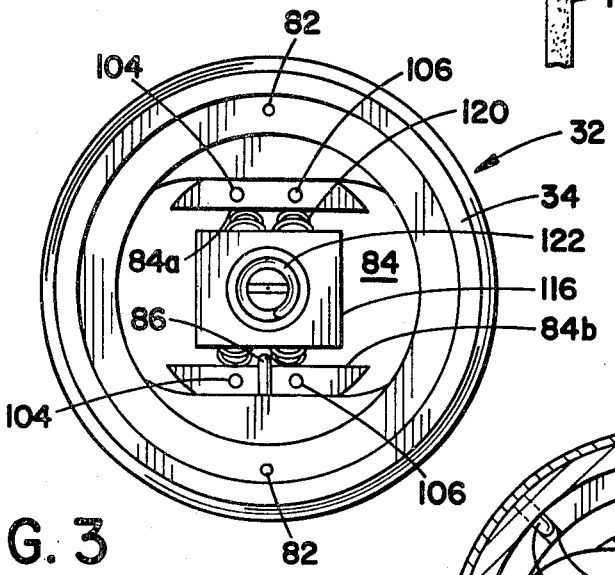
FIG. 3
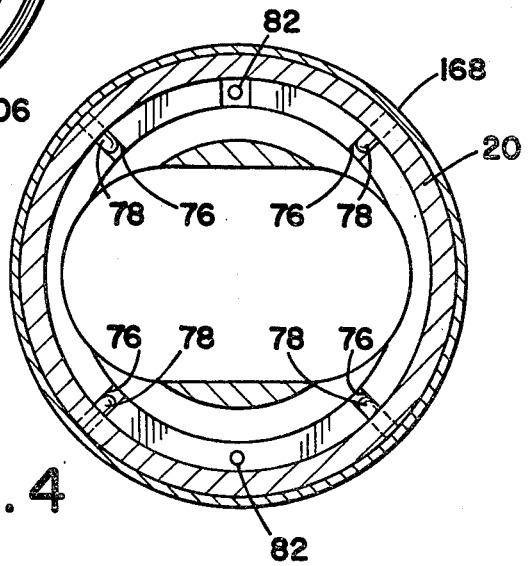
FIG. 4

FIG. 5
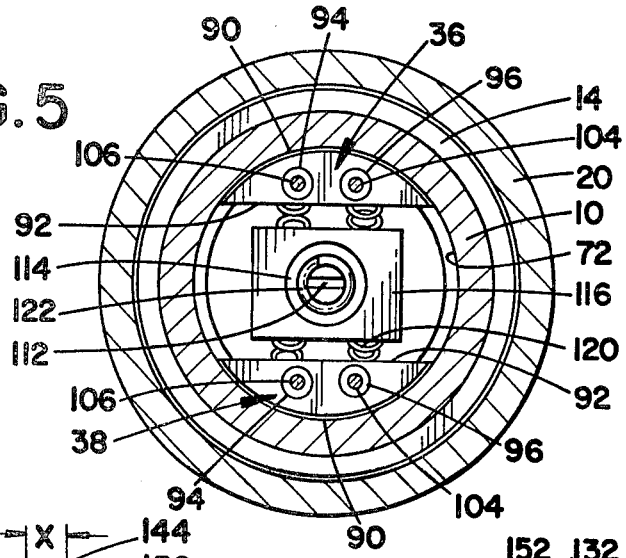
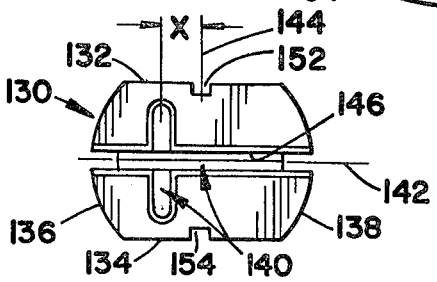
FIG. 6
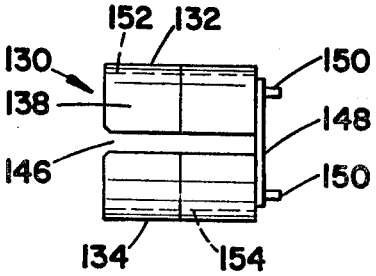
FIG. 7
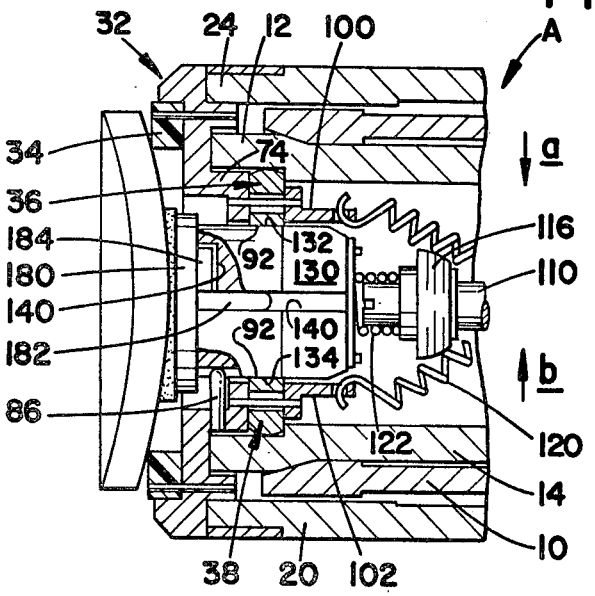
FIG. 8

FIG. 10
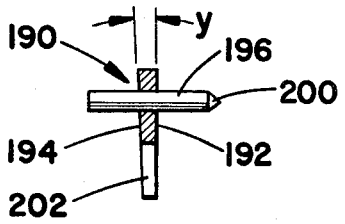
FIG. 9
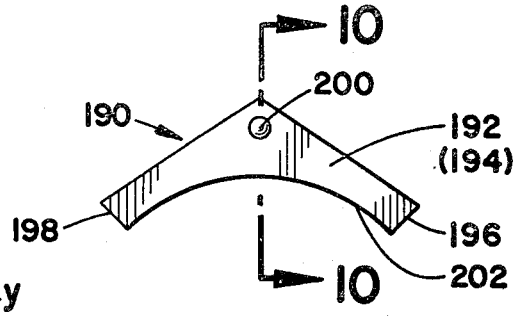
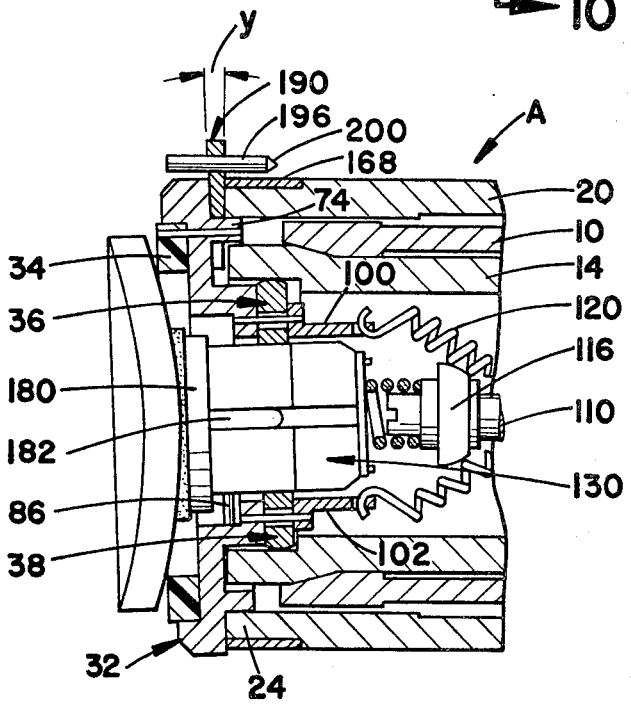
FIG. 11

LENS PROCESSING METHOD AND APPARATUS

BACKGROUND OF THE INVENTION

This application pertains to the art of optics and more particularly to optical lenses.

The invention is particularly applicable to a lens blank processing method and apparatus for eyeglass lenses and will be described with particular reference thereto. However, it will be appreciated by those skilled in the art that the invention has broader applications and may be adapted for practical use in processing other types of optical lenses employed in various environments.

In the commonly assigned U.S. patent application Ser. No. 44,991, filed June 4, 1979 now U.S. Pat. No. 4,267,672, and allowed Oct. 3, 1980, new lens processing method and apparatus were disclosed which successfully overcame a number of problems heretofore encountered with prior known lens processing equipment and techniques. Both essential and non-essential subject matter from this prior application are incorporated hereinto by reference.

In practicing the invention of the above referenced application, conventional lens generating apparatus is employed, although it is necessary to slightly modify the generator tailstock to accommodate the lens blank chuck assembly. The modifications are such that only frame center type lens grinding operations could be performed. Moreover, the modifications were such that ready conversion of the lens generator for use in grinding so-called alloyed blocked lenses was prevented. It has, therefore, been considered desirable to develop method and apparatus for allowing the same overall results to be obtained as are described in application Ser. No. 44,991 while at the same time allowing ready conversion of the lens generating apparatus tailstock as between frame center grinding operations and alloy blocked lens grinding operations.

The subject invention contemplates improved method and apparatus which meet these needs and others to provide lens processing method and apparatus which are simple, require only single blocking of the lens blank during the entire processing thereof into a finished lens, are economical to use, are useful in generating substantially all types of single and multivision prescriptions and are adaptable to application in other environments.

BRIEF DESCRIPTION OF THE INVENTION

In accordance with the present invention, there is provided a lens blank chuck assembly which facilitates desired positioning of a lens blank secured to a lens block or other retaining means relative to the tailstock of lens surface generating apparatus. The tailstock has an elongated generally cylindrical collet extending coaxially outward therefrom. The chuck assembly itself includes a hollow generally cylindrical chuck body housing having spaced apart first inner and second outer ends with the inside diameter of the housing being greater than the outside diameter of the collet. Mounting means are provided at the chuck body housing first end adapted for mounting the assembly to the tailstock coaxially and generally coextensive with the collet. This mounting means is such that the chuck body housing may be selectively rotated about the tailstock axis. Receiving means adjacent the chuck body housing second end is adapted to retainingly receive a lens block which has one face of a lens blank secured thereto at generally the lens blank frame center axis. This receiving means includes means for positioning the frame center axis so that a predetermined desired optical center axis for the lens blank is positioned generally coaxial with the tailstock longitudinal axis to effect lens blank decentration. A pair of opposed spaced apart retaining members are operatively interposed radially between the receiving means and the collet of the lens generating apparatus. These retaining members are radially movable in response to selective closing and opening of the collet for causing the receiving means to be placed in lens block clamping and non-clamping conditions.

In accordance with another aspect of the invention, the chuck assembly further includes a lens blank face plate disposed at the chuck body housing second end and a lens blank support received by that portion of the face plate facing outwardly of the second end adapted to provide additional support for a lens blank at the one face thereof. The retaining members are operatively secured to that portion of the face plate facing inwardly into the housing and first biasing means continuously urge the face plate toward a first normal position in engagement with the chuck body housing second end.

According to another aspect of the invention, the receiving means comprises a removable decentration bar having a lens block receiving opening therethrough generally closely configured to the mounting portion of the lens block. This receiving opening is located in the decentration bar so that a predetermined amount of lens blank decentration will automatically be effected when the bar is mounted in the chuck body housing. Also, the receiving opening is configured so that it is movable under the influence of the retaining members between the lens block clamping and non-clamping conditions.

According to an additional aspect of the invention, canting means are provided for selectively positioning the lens blank in a manner so that the optical center axis thereof is canted relative to the tailstock longitudinal axis for allowing some predetermined amount of prism to be imparted thereto. According to the preferred construction, this canting means comprises a shim member interposed between the face plate and the chuck body housing second end at some predetermined cooperative area therebetween.

In accordance with another aspect of the present invention, a method is provided for generating an optical prescription into a lens blank surface which only requires a single mounting of the lens blank to an associated lens block.

According to still another aspect of the invention, a new lens block chuck assembly is provided in combination with a lens generating apparatus. The generator apparatus has a tailstock which includes a hollow generally cylindrical collet extending coaxially outward therefrom and wherein at least the collet outermost end is selectively movable between an open position and a closed position radially contracted from the open position.

The principal object of the invention is the provision of a new and improved lens processing method which require only a single lens blank blocking step for the entirety of the lens processing operations into a finished lens.

Another object of the invention is the provision of such method which allow ready conversion of the lens generator to use between frame center grinding and alloy blocked lens grinding.

Still another object of the invention is the provision of lens processing method which are readily adapted to allowing substantially all desired prescription characteristics to be imparted into lens blanks for both single and multivision lenses.

Additional objects and advantages for the invention will become readily apparent to those skilled in the art upon a reading and understanding of the following specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein:

FIG. 1 is a side elevational view of a lens blank chuck assembly formed in accordance with the present invention;

FIG. 3 is an end view taken along lines 3—3 of FIG. 2;

FIG. 4 is a partial cross-sectional view taken along lines 4—4 of FIG. 2;

FIG. 5 is a cross-sectional view taken along lines 5—5 of FIG. 2;

FIG. 6 is a front elevational view of a decentration bar utilized in conjunction with the subject new chuck assembly;

FIG. 7 is an end view of the decentration bar shown in FIG. 6;

FIG. 8 is a cross-sectional view of a portion of the chuck assembly shown in FIG. 2 with the decentration bar and a lens block with lens blank operatively mounted thereto;

FIG. 9 is a front elevational view of a shim member selectively utilized in conjunction with the subject new chuck assembly;

FIG. 10 is a cross-sectional view taken along lines 10—10 of FIG. 9; and, FIG. 11 is a cross-sectional view similar to FIG. 8 with the shim member installed between the chuck assembly housing and face plate.

DETAILED DESCRIPTION OF THE PREFERRED EMBODIMENT

Figure 2:
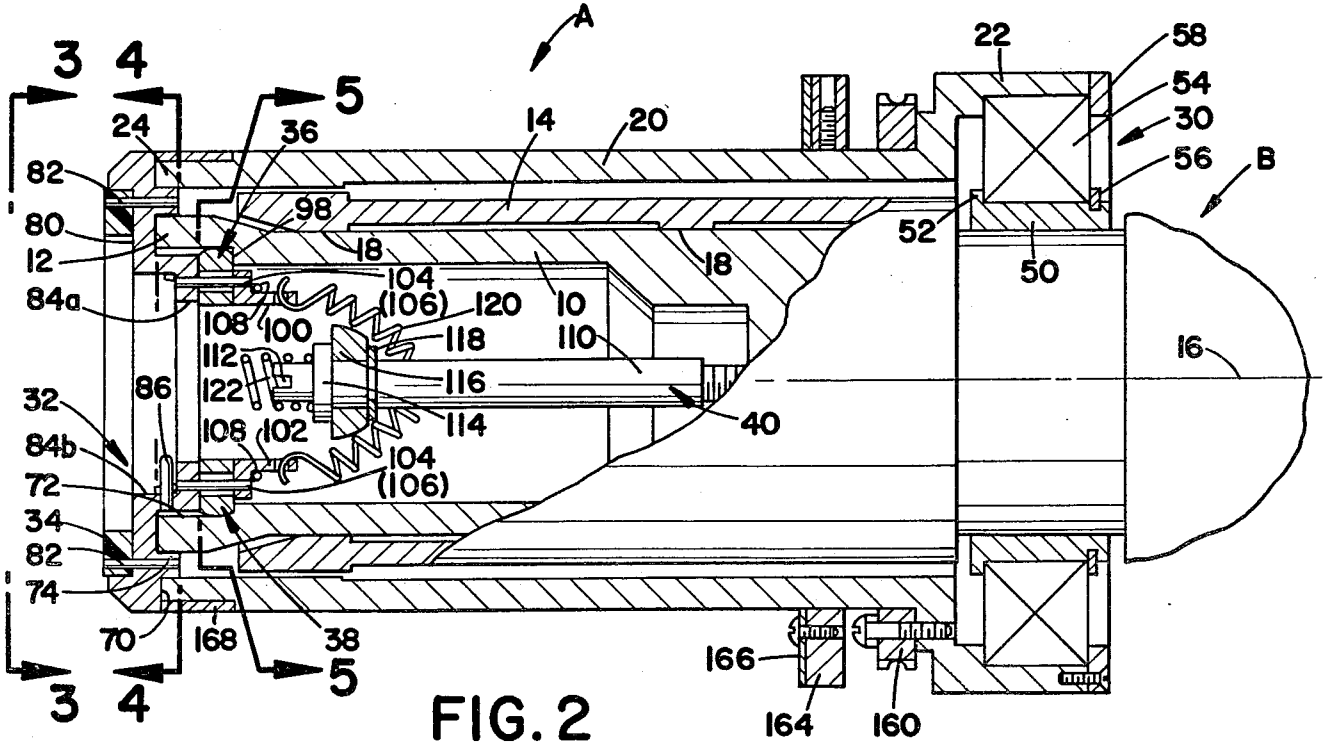
FIG. 2 is a partial cross-sectional view of the assembly shown in FIG. 1.

Referring now to the drawings wherein the showings are for purposes of illustrating the preferred embodiment of the invention only and not for purposes of limiting same, FIG. 1 depicts a lens blank chuck assembly A operatively associated with the tailstock B of a conventional lens generating apparatus (not shown). Both essential and non-essential subject matter are incorporated hereinto by reference from the commonly assigned U.S. Pat. application Ser. No. 44,991, filed June 4, 1979 and allowed Oct. 3, 1980.

More particularly, the lens surface generating apparatus for which the chuck assembly herein described has been assigned is marketed by Coburn Optical Industries, Inc. In such apparatus, and with particular reference to both of FIGS. 1 and 2, tailstock B includes a hollow generally cylindrical collet 10 extending coaxially outward therefrom toward an outermost end area 12. A cylindrical collet actuating sleeve 14 also extends coaxially of tailstock B toward collet outer end area 12 in an actuating relationship therewith. The longitudinal axis of the tailstock is designated by numeral 16 in the FIGURES. Collet 10 comprises an integral portion of the lens generating apparatus itself and is known in the art. While a sleeve similar to sleeve 14 normally also comprises a part of the generating apparatus, it is replaced by the specially designed sleeve 14 which includes circumferential shoulders at spaced intervals along the inside and outside diameters thereof for providing increased stability for chuck body 10. The sleeve is selectively movable by hydraulic means (not shown) axially of the collect into and out of actuating engagement with outer end 12 for causing radial contraction and expansion thereof as is known. Collet 10 and sleeve 14 remain with and as part of tailstock B when chuck assembly A is removed to accommodate changeover from a frame center lens grinding operation to an alloy blocked lens grinding operation. This particular capability was not present in the structure disclosed by that application which is incorporated hereinto by reference.

With continued reference to both FIGS. 1 and 2, chuck assembly A includes a hollow generally cylindrical chuck body housing 20 having a first or inner end 22 and a second or outer end 24. Mounted within and/or otherwise associated with body 20 and collet 10 is a bearing assembly generally designated 30, a face plate 32, a lens ring 34, retaining members or wedge bars 36,38 and a retaining screw assembly 40.

More particularly, bearing assembly 30 includes a bearing seat ring 50 received in a circumferential groove in tailstock B. This bearing seat ring includes a bearing retaining flange 52 extending outwardly from one side edge thereof with a conventional roller bearing or the like, schematically shown in FIG. 2 and designated by numeral 54, being received between the outer bearing surface of seat ring 50 and the inner surface of housing 20 at first or inner end 22. This first end is slightly enlarged in diameter and includes a stepped area for convenient retention at the bearing inner side edge. A retaining ring 56 such as a snap ring or the like maintains the bearing in position at the seat ring other side edge. Similarly, a retaining ring 58 is secured as by conventional mechanical fasteners or the like to chuck body first end 22 so as to extend slightly radially inward thereof for retaining body 20 on the bearing. Collet 10 and sleeve 14 are non-rotatable relative to tailstock B whereas bearing assembly 30 allows chuck body assembly A to be selectively rotated about tailstock axis 16 in a manner to be described.

With particular reference to FIGS. 2, 3 and 4, face plate 32 is shown as including an inner or rear face having an outer circumferential groove 70 and an inner circumferential groove 72 which define a rearwardly extending rim-like area 74 therebetween. As seen in FIG. 2, groove 70 is dimensioned in a manner such that a portion of face plate 32 is received within second or outer end 24 of chuck body housing 20. The radial end wall of outer groove 70 engages the end face of the chuck body housing with rim 74 being closely spaced toward the housing inner peripheral surface. Inner groove 72 has a depth sufficient to receive collet outer end area 12 and a width slightly greater than the thickness of outer end 12 to accommodate radial contraction and expansion thereof. As shown in FIG. 2, collet 10 is in the open or expanded position.

An arrangement for obtaining a positive located relationship between chuck body housing 20 and face plate 32 which allows relative axial movement and prevents relative rotational movement therebetween is shown in FIG. 4. For that purpose, rim 74 includes a plurality of radially disposed slots 76 extending thereinto from the rear face thereof. While a number of such slots could be advantageously employed, the preferred embodiment has four slots 76 equidistantly spaced from each other. A plurality of radially extending pins 78 extend through chuck body housing 20 adjacent second or outer end 24 into locating communication with slots 76. The relationship between the slots and pins is such that a predetermined rotated relationship between face plate 32 and housing 20 is thus obtained. In addition to preventing relative rotation between the two components, the slot and pin arrangement allows face plate 32 to be selectively withdrawn axially outward from housing outer end 24. This permissible axial movement is desirable to accommodate adjustment for prism in a manner which will be described in more detail hereinafter.

As best shown in FIGS. 2 and 3, lens ring 34 is received in a recessed area 80 in the outer or front face of face plate 32 and is fixedly secured to the face plate by pins 82 extending therebetween axially of the chuck assembly. While the connecting means may be varied as deemed necessary and/or appropriate, the preferred embodiment here under discussion contemplates use of conventional roll pins or the like. Face plate 32 further includes a generally elongated slot area 84 extending therethrough having opposed side edges and opposed arcuate end edges for receiving a decentration bar as will be described. The effective side edges of slot 84 are defined by protruding areas **84*a*,84*b* disposed at the rear face of the seat ring. Lens ring 34 may include a somewhat irregular inner peripheral conformation to facilitate maximum decentration of a lens blank as may be required without encountering interference as between the lens block and lens ring. The irregular inner peripheral conformation is typically found in those lens rings employed for grinding plastic lenses. In the preferred arrangement, lens ring 34** is constructed from a fairly hard plastic or plastic-like material, although other materials could also be advantageously employed. The lens ring provides support for an associated lens blank outwardly of the lens block in a manner to be described.

As will be seen from FIGS. 2 and 3, seat ring 32 includes a decentration bar locating pin 86. This pin is spring loaded and received in a mounting opening forwardly adjacent protruding area **84*b* centrally of opening 84** in radial alignment with the seat ring center. The pin is continuously urged to an extended position in the mounting opening by convenient spring biasing means in a manner and for purposes which will become more readily apparent hereinafter.

Retaining members or wedge bars 36,38 are best shown in FIGS. 2 and 5. These members are oppositely disposed from each other diametrically of chuck assembly housing 20 with each member 36,38 including an arcuate outer peripheral surface 90 radiused compatible with the interior of collet outer end area 12. Each member also includes a planar retaining surface 92 disposed generally coextensive and parallel with protruding areas **84*a*,84*b* of face plate slot 84. A pair of mounting openings 94,96 extend through each of members 36,38 generally axially of the chuck assembly and are employed for mounting purposes in a manner to be described. As shown in FIG. 2, the thickness of retaining members or wedge bars 36,38 is such that they are positioned in the chuck assembly between a radial shoulder or wall 98 defined by an internal circumferential groove at collet outer end area 12 and the inner or rear face of face plate 32**.

Generally L-shaped spring clips 100,102 are operatively associated with or mounted to face plae 32 and retaining members or wedge bars 36,38, respectively, at the rear side of the retaining members. Each of spring clips 100,102 is pinned at 104,106 to the associated retaining member or wedge bar and to an associated area of face plate 32 as best seen in FIGS. 2, 3 and 5. In the preferred arrangement, conventional roll pins or the like are employed, although other means could also be advantageously utilized. The diameters of mounting openings 94,96 in each of members 36,38 are greater than the roll pins so that some radial movement of the members relative to each other within the chuck assembly may be obtained. Thus, members 36,38 are essentially captured between face plate 32 and spring clips 100,102. The roll pins are closely or securely received in the face plate and spring clips for retaining them in a fixed spaced apart relationship which will accommodate selective radial movement of members 36,38. Spring or biasing arrangements 108 (FIG. 2) are cooperatively disposed between retaining member 36 and spring clip 100 and between retaining member 38 and spring clip 102 for continuously urging members 36,38 radially outward of each other to an open condition. Spring arrangements 108 may take any convenient form, although they are fabricated from music wire in the preferred embodiment shown.

In FIG. 2, retaining screw assembly 40 is shown as having an elongated shaft portion 100 threadedly mounted at one end to the inner end wall of collet 10 so as to extend coaxially of tailstock B. The other end of the shaft is slotted as at 112 to provide convenient access for a screwdriver or like tool to accommodate installation and removal of assembly 40 from association with tailstock B when it is desired to convert the lens generating apparatus between a frame center grinding operation and an alloy block lens grinding operation. A slightly enlarged head 114 is provided adjacent slot 112 to define a spring plate stop. A spring plate 116 is, in turn, rotatably received on shaft 110 adjacent the head. A snap or retaining ring 118 is received by the shaft to prevent axial movement of the spring plate in a rearward direction.

A pair of expansion springs 120 each have one end connected to spring clip 100 and the other end connected to spring clip 102 with the intermediate portions extending around spring plate 116. The spring plate may include convenient grooves or the like (not shown) for retaining the springs in position thereon. In like fashion, a compression spring 122 extends axially outward from the forward end of shaft 110 a distance extending at least partially between retaining members or wedge bars 36,38. The relationship of springs 120, as between retaining screw assembly 40 on the one hand and face plate 32, retaining members 36,38 and spring clips 100,102 on the other, is such to cause the face plate to be continuously biased axially of housing 20 into a first normal position in positive located engagement with housing second end 24 in the manner shown in FIG. 2. Compression spring 122 acts as an ejector for a decentration bar as will be described.

FIGS. 6 and 7 show the construction for a decentration bar used with chuck assembly A wherein the bar is generally designated by numeral 130. The block has opposed planar sides 132,134 and opposed arcuate ends 136,138. A lens block receiving opening 140 has a generally or cross-shaped configuration for receiving a lens block of the type fully described in that subject matter incorporated hereinto by reference. One leg of opening 140 extends along the horizontal axis 142 of the bar while the other leg extends at least parallel to the vertical axis 144. In practice, the horizontal leg of receiving opening 140 is defined by a through slot 146 which effectively divides the bar in half. The halves are, in turn, retained in the spaced relationship shown in FIG. 6 by means of a rear retainer plate 148 (FIG. 7). The retainer plate and decentration bar halves are interconnected as at areas 150 by convenient means such as roll pins, threaded fasteners or combinations thereof.

The thickness of retainer plate 148 is such that the bar halves may be pivoted slightly thereat so as to effect selective movement of the sides of slot 146 toward each other for clamping a lens block therebetween as will be described. Also, axial guide slots 152,154 are included in opposed sides 132,134, respectively, of the decentration bar. These slots are substantially coplanar with a vertical plane which includes axis 144 and are used for precisely locating the decentration bar in chuck assembly A as will become apparent.

In practice, a plurality of decentration bars 130 are provided which are identical to each other except for the location of lens block receiving opening 140 relative to axis 144. As shown in FIG. 6, the vertical leg of this opening is laterally spaced some predetermined distance x from axis 144. Distance x is calculated so as to automatically obtain a desired amount of lens blank decentration along horizontal axis 142 when the decentration bar is mounted in chuck assembly A. Thus, decentration is obtained simply by selecting a particular one of the decentration bars in accordance with the lens prescription and no lateral adjustment of any clamp means is necessitated as in the case of those teachings incorporated hereinto by reference. In the preferred arrangement, twenty-one (21) different decentration bars 130 are provided with the dimension x varying from each other by a distance of 0.5 mm. so that the decentration range is from 0 mm. to 10.0 mm. Other combinations may also be employed commensurate with accepted lens grinding practice.

Referring again to FIG. 2, a pulley 160 extends circumferentially of housing 20 axially adjacent first end 22 and is secured thereto by convenient means such as mechanical fasteners or the like. A drive belt 162 is entrained about pulley 160 and extends to a drive arrangement or means (not shown) for purposes of allowing incremental rotational adjustment of chuck assembly A relative to tailstock B. A scale ring 164 extends circumferentially of housing 20 axially adjacent pulley 160 and is affixed to the housing by convenient means such as mechanical fasteners or the like. An angular scale 166, in turn, is fixedly secured to one face of scale ring 164 for purposes of determining the rotated position of the chuck assembly between a first home position and a second rotated position arcuately spaced from the home position. A pointer (not shown) associated with the lens generator cooperates with scale 166 for convenient reading of the chuck assembly rotated position. Rotation of the chuck assembly relative to the tailstock allows a lens blank base line to be oriented relative to the generating apparatus in accordance with a lens prescription. A drum dial 168 extends circumferentially of the chuck body housing adjacent second end 24 for use in adjusting the face plate relative to the chuck housing to impart any prescribed prism to a lens blank in a manner to be described. Both scale 166 and drum dial 168 are readable from 0° to 360° in 1° increments.

FIG. 8 shows installation of a lens block with lens blank into chuck assembly A for a lens grinding operation. The lens blank, lens block and the mounting of one to the other are substantially the same as described in those teachings which are incorporated hereinto by reference. The chuck assembly is normally rotated to the first home position as indicated between the pointer (not shown) and scale 166. The appropriate decentration bar 130 (FIG. 6) is selected in accordance with the particular lens prescription involved and the lens block 180 with lens blank then inserted into the decentration bar so that lens block mounting tab 182 is received in that portion of lens block receiving opening 140 which extends along horizontal axis 142 (FIG. 6). Lens block locating tab 184 is, in turn, received in a portion of the other leg of the mounting opening. Depending upon the particular prescription and whether a left or right eye lens is involved, it may be necessary to rotate the lens blank and lens block 180° from the position shown in FIG. 8.

Once the lens block has been appropriately positioned in decentration bar 130, the components are moved axially into the chuck assembly with one of decentration bar guide slots 152,154 receiving locating pin 86. The axial insertion continues until the convex lens blank surface engages lens ring 34 in the manner shown in FIG. 8. As also shown in FIG. 8, sides 132,134 of the decentration bar are interposed between seat ring projecting areas **84*a*,84*b* and between the opposed retaining surfaces 92 of retaining members or wedge bars 36,38. At the same time, compression spring 122** is slightly compressed due to engagement thereof by the rear end area of the decentration bar.

The lens blank is held in the position shown in FIG. 8 and the collet actuating sleeve energized so that collet outer end 12 is radially contracted. Such contraction causes retaining surfaces 92 of the retaining members to be driven radially in directions a-b into retaining engagement with decentration bar sides 132,134. This radial movement is made possible by the particular mounted relationship as between face plate 32, members 36,38 and spring clips 100,102 as described above. The retaining force imparted to decentration bar sides 132,134, in turn, causes the opposite sides of slot 146 (FIG. 6) to be forced toward each other about retainer plate 150. Thus, that portion of lens block receiving opening 140 which is defined by slot 146 is moved into clamping engagement with lens block mounting tab 180.

Once clamped as described above, and because of the various coaxial relationships of the chuck assembly components relative to the tailstock, decentration bar 130 acts to automatically adjust the lens blank for decentration. That is, the decentration bar which is selected as a function of the lens prescription adjusts a desired optical center axis in the lens blank to a position coaxial with both the generator tailstock B and chuck assembly A. In the event axis is required to be imparted to the lens blank in accordance with the prescription, such axis is obtained by rotating the chuck assembly A (FIG. 1) relative to the tailstock B by means of appropriate rotate means (not shown) interconnected with pulley 160 via drive belt 162. Scale 166 provides convenient readout for such adjustment. Grinding of the lens blank may thereafter be effected.

Following grinding, collet 10 is opened by shifting sleeve 14 to thereby release the retaining pressure exerted by retaining members 36,38 against the decentration bar. Spring arrangements 108 (FIG. 2) act to separate members 36,38 radially outward of each other. At the same time, compression spring 122 (FIG. 8) urges or kicks out decentration bar 130 with the lens blank and lens block from association with the chuck assembly in order that the next lens blank may be processed.

In the event it is necessary to add prism to the lens blank in accordance with the lens prescription, a further adjustment is necessary to the chuck assembly prior to grinding as is shown in FIGS. 9, 10 and 11. In particular, the prism adjustment is obtained by utilizing a prism shim having predetermined shim characteristics interposed between face plate 32 and housing second end 24.

FIGS. 9 and 10 show one such shim 190, it being appreciated that the other shims are identical thereto except for the specific shim characteristics thereof. In particular, the shim 190 has opposed planar faces 192,194 extending between spaced apart ends 196,198. A pointer 200 extends through the shim adjacent the outer edge area thereof and is normal to the plane of face 192. Pointer 200 is adapted to cooperate with drum dial 168 (FIG. 1) to secure proper shim placement circumferentially of the chuck assembly in accordance with the lens prescription. Face 194 is angularly disposed relative to face 192 so that an angle y is defined therebetween. The amount or degree of angle y determines the canted relationship between the lens block optical center axis and longitudinal axis 16 (FIG. 2) of tailstock B. The thickness of shim 190 increases from end 196 toward a maximum thickness at the central area and then decreases in thickness from the central area toward end 198. Arcuate inner edge 202 of the shim has a radius which allows it to be closely received against a portion of face plate 32. In the preferred embodiment of the invention, a total of sixteen (16) different shims are provided and comprise a shim set. Each shim has a different shim angle y to permit a range of different prism characteristics to be obtained in accordance with conventional prescription requirements. The number of shims may, however, be varied as deemed necessary or appropriate.

FIG. 11 is a view similar to FIG. 8 but for the inclusion of a shim 190 for obtaining prism in the lens blank. As hereinabove described, face plate 32 is axially movable outwardly of the chuck body housing from second end 24 against the opposite biasing force of expansion springs 120 (FIG. 2). Likewise, the relationship between slots 76 and pins 78 (FIG. 4) in the face plate and housing accommodates such movement. Thus, to install shim 190, it is merely necessary to pull the face plate outwardly a short distance from housing second end 24, insert the shim at the appropriate location circumferentially of the housing and then move the face plate back toward its normal psition. Shim inner edge 202 engages face plate rim 74 and pointer 200 is aligned with the appropriate angular reading on drum dial 168. Because of the physical interconnection between the face plate 32 and retaining members 36,38, both the face plate and retaining members will be canted by the predetermined angle y so that the desired prism characteristics will be incorporated into the lens blank at grinding.

Following lens blank processing in chuck assembly A, the lens blank may be further processed and completed in the same manner set forth in detail by those teachings which are incorporated hereinto by reference. In addition, and except for the manner in which lens blank decentration is obtained in the chuck assembly described herein, the overall method of lens blank processing is substantially the same as that described in the subject matter which is incorporated hereinto by reference. Accordingly, further detailed elaboration on these features is deemed unnecessary.

A particular advantage to the subject new chuck assembly A resides in the fact that it utilizes the collet portion of existing lens and known generating apparatus to achieve clamping for the lens blocks. Thus, the generator tailstock remains substantially intact so that the associated lens generating apparatus may be readily converted between use in frame center grinding operations employing chuck assembly A and alloy block lens grinding operations. Removal of the chuck assembly from association with tailstock B is accomplished by removing retaining ring 58 (FIG. 2) from housing first end 22, unthreading retaining screw assembly 40 from association with collet 10 and then axially moving the entire chuck assembly away from the tailstock. Reinstallation of the chuck is performed merely by reversing the foregoing steps. This conversion feature has not been available in chuck assemblies heretofore available and represents a substantial improvement thereover.

The invention has been described with reference to the preferred embodiment. Obviously, modifications and alterations will occur to others upon the reading and understanding of this specification. It is intended to include all such modifications and alterations insofar as they come within the scope of the appended claims or the equivalents thereof.

Having thus described the invention, it is now claimed:

1. A method of generating an optical prescription into a lens blank which only requires a single mounting of said lens blank to an associated lens block, said method comprising the steps of:

providing a lens blank having a frame center axis and a peripheral size substantially greater than the peripheral size of a finished optical lens to be formed from said lens blank;

providing a reuseable preformed lens block having a peripheral size which is not greater than the peripheral size of said finished optical lens, said lens block including means for mounting same to a chuck and having a longitudinal mounting axis;

affixing said lens block to said lens blank so as to extend outwardly from the face thereof which is opposite to the lens blank face which is to be processed and with said longitudinal mounting axis substantially aligned with said frame center axis;

installing a preselected lens block receiver in operative communication with a chuck coaxially disposed in mounted communication with a tailstock of lens generating apparatus, said lens block receiver including means for locating said lens block so that said lens blank may be placed in a predetermined position relative to said chuck;

placing said lens block in operative mounted communication with said lens block receiver such that a desired optical center axis of said lens blank is located substantially coaxial with the longitudinal axis of said tailstock to thereby accommodate a predetermined desired amount of lens blank decentration;

generating the desired optical surface on said lens blank processed face and thereafter removing said lens block and lens blank from association with said chuck;

performing subsequent operations for producing said finished optical lens while the same said lens block remains affixed to said lens blank for mounting said lens block and lens blank in subsequent processing apparatus;

said step of performing subsequent operations being carried out without changing the physical characteristics of said lens block; and, deblocking said finished optical lens from said lens block for reuse of said lens block in processing other lens blanks.

2. The method as defined in claim 1 further including between the steps of placing and generating the step of rotating said lens blank about said tailstock longitudinal axis a predetermined arcuate distance from a first normal position to a second position for setting a base line axis for said lens blank relative to said lens surface generating apparatus for imparting desired optical characteristics into said lens blank during said step of generating.

3. The method as defined in claim 1 further including prior to the step of generating the step of canting said lens blank such that the optical center axis thereof is canted a predetermined amount relative to said tailstock longitudinal axis for imparting a predetermined desired amount of prism into said lens blank during said step of generating.

4. The method as defined in claim 1 wherein said step of performing subsequent operations includes the steps of mounting said lens block and lens blank in polishing apparatus having a chuck such that said lens blank frame center axis is substantially coaxial with the longitudinal axis of said polishing apparatus chuck; polising the processed face of said lens blank; positioning said lens block and lens blank in edging apparatus such that said lens blank frame center axis is substantially coaxial with the longitudinal axis of an edging apparatus chuck; edging said lens blank to have a predetermined desired peripheral edge configuration; and, thereafter deblocking said lens block from the finished lens.

5. The method as defined in claim 1 wherein said lens blank has an optical axis spaced from said frame center axis along a lens blank base line and said step of providing a lens block is carried out by providing a lens block having alignment means for alignment with said base line, and said steps of placing said lens block in mounted communication with a chuck and of performing subsequent procedures being carried out by using said alignment means for properly mounting said lens block for accurate subsequent locating of lens position to form a desired optical surface thereon.

* * * * *